US007198516B1

(12) United States Patent
Kemelman et al.

(10) Patent No.: US 7,198,516 B1
(45) Date of Patent: Apr. 3, 2007

(54) KEYED CABLE ASSEMBLY TO RESTRAIN CABLE UNDER MULTIAXIS STRESS

(75) Inventors: Yonatan D. Kemelman, Hertzelia (IL); Eli Margalit, Ra'Anana (IL); Ariel Rotman, Ramat Efal (IL); Uzi Cohen, Shoham (IL)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/224,544

(22) Filed: Sep. 12, 2005

(51) Int. Cl.
*H01R 13/58* (2006.01)

(52) U.S. Cl. ..... 439/604

(58) Field of Classification Search ..... 439/604, 439/447, 456, 371, 345, 449, 568
See application file for complete search history.

(56) References Cited

U.S. PATENT DOCUMENTS 4,784,616 A * 11/1988 Zimmermann ..... 439/568
6,220,888 B1 * 4/2001 Correa ..... 439/445
6,270,370 B1 * 8/2001 Chien ..... 439/371

* cited by examiner

*Primary Examiner*—Phuong Dinh

(57) ABSTRACT

A connector assembly is provided for a portable device. The connector assembly includes a U-shaped connector head with a connector extending from a first end of the U-shaped connector head and a stress relief overmold extending from a second end of the U-shaped connector head, said stress relief overmold having a pair of annular grooves disposed along a length of the stress relief overmold transverse to the extension of the overmold and a cradle mechanically coupled to the portable device that engages the pair of grooves to retain the connector head in a relatively fixed relationship with respect to the portable device.

16 Claims, 3 Drawing Sheets

KEYED CABLE ASSEMBLY TO RESTRAIN CABLE UNDER MULTIAXIS STRESS

FIELD OF THE INVENTION

The field of the invention relates to portable devices and more particularly to power supply cables used to power portable devices.

BACKGROUND OF THE INVENTION

The use of portable devices in vehicles is well known. Examples include cellular telephones, radar detectors, video players, etc. Where such use is frequent or use occurs over long periods, the portable devices are often provided with plugs adapted to receive power from a cigarette lighter of the vehicle.

In order to allow broad flexibility of use, the cigarette lighter cord is often of sufficient length to allow a user in the back seat of a vehicle to use the portable device while the cord in plugged into a cigarette lighter outlet on the dashboard. However, the presence of a long cord is inconvenient for a user in the front seat. Further, many vehicles are provided with cigarette lighter outlets in both front and back seats which often tends to cause device providers to only supply short cords.

However, when short cords are involved and few outlets are available, the power cords often receive a great deal of twisting and bending. Not only do children pull on cords that are too short, but the side-to-side movement of the vehicle during use causes additional stress on the cords and their connectors. Failure often occurs proximate the connectors on these cords.

In order to enhance the durability and lifetimes of portable cords, strain relief bushings are often provided proximate the connectors. Strain relief bushings function by reducing the flexing of the cord proximate the connector and by moving the point of flexing away from the connector. While strain relief bushings are effective, they do not protect the delicate electrical contacts and support structures within multicontact connectors. Accordingly, a need exists for a connector that is more rugged and less subject to damage.

SUMMARY

A connector assembly is provided for a portable device. The connector assembly includes a U-shaped connector head with an electrical connector extending from a first end of the U-shaped connector head and a stress relief overmold extending from a second end of the U-shaped connector head, said stress relief overmold having a pair of annular grooves disposed along a length of the stress relief overmold transverse to the extension of the overmold and a cradle mechanically coupled to the portable device that engages the pair of grooves to retain the connector head in a relatively fixed relationship with respect to the portable device.

DETAILED DESCRIPTION OF AN ILLUSTRATED EMBODIMENT

Figure 1:
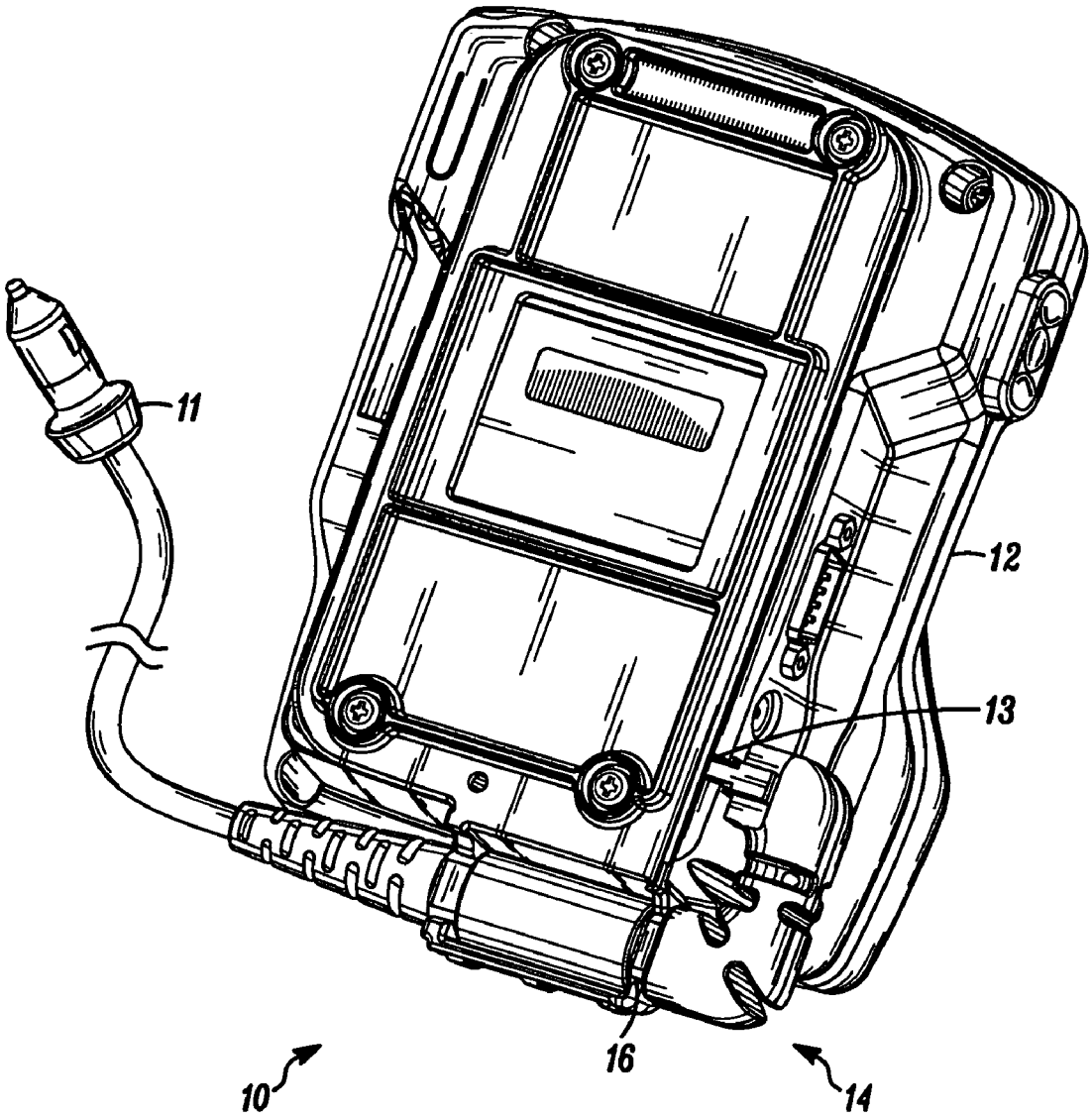
FIG. 1 is a side perspective view of a connector assembly in a context of use in accordance with an illustrated embodiment of the invention.

FIG. 1 is a side perspective view of a connector assembly 10 shown generally in accordance with an illustrated embodiment of the invention and in a context of use with a portable device 12. The portable device 12 may be any of a number of portable devices used within a vehicle (e.g., cellphone, Bluetooth radio frequency repeater for a laptop, etc.)

The connector assembly 10 may supply power to the portable device 12 from a plug 11 adapted to fit a cigarette lighter. In general, the connector assembly 10 includes a connector body 14 (shown in more detail in FIG. 2) and a cradle 16 (shown in more detail in FIG. 3).

In general, the connector body 14 includes a U-shaped connector head 18, electrical electrical connector 20 and a stress relief overmold 22. The electrical connector 20 extends from a first end of the U-shaped connector head 18 and the stress relief overmold 22 extends from a second end of the U-shaped connector head 18.

In general, the U-shaped connector head 18 and stress relief overmold 22 together form a relatively rigid supporting structure that functions to direct stress from the cable 24 into the housing of the portable device 12. The U-shaped connector head 18 and stress relief overmold 22 may be formed by injection molding a suitable material (e.g., rubber) into the shape shown in FIG. 2. In one embodiment, the U-shaped connector head 18 and the stress relief overmold 22 together are termed an L-shaped connector.

As part of the stress relief overmold 22 is a pair of annular slots or grooves 26, 28 transverse to a predominant axis of the stress relief overmold 22. One groove 28 may be formed in the stress relief overmold 22 at the junction between the stress relief overmold 22 and U-shaped connector head 18. The second groove 26 may be formed at the base of the stress relief overmold 22.

The cradle 16 may include a semicircular (tubular) receiver 34 and attachment plate 36 formed of an appropriate resilient material (e.g., plastic). In some embodiments, the cradle 16 may be molded into the case of the portable device 12 (as may be depicted by FIG. 1) and, therefore, may not need the attachment plate 36. The semicircular (tubular) receiver 34 may include a pair of ridges 30, 32 disposed on an inside annular surface of the semicircular (tubular) receiver 34 that form semicircular recesses that engage the grooves 26, 28 in the stress relief overmold.

The opening 38 at the top of the cradle 16 may have a width that is less than a diameter of the stress relief overmold 22. As a result, when the stress relief overmold 22 is pushed into the cradle 16, the outside lip (edge) 40 of the cradle 16 is deformed outwards until the stress relief overmold 22 seats at the bottom of the cradle 16 at which time the outside lip (edge) 40 returns to its original shape, thereby releasably locking the stress relief overmold 22 into the cradle 16.

Figure 2:
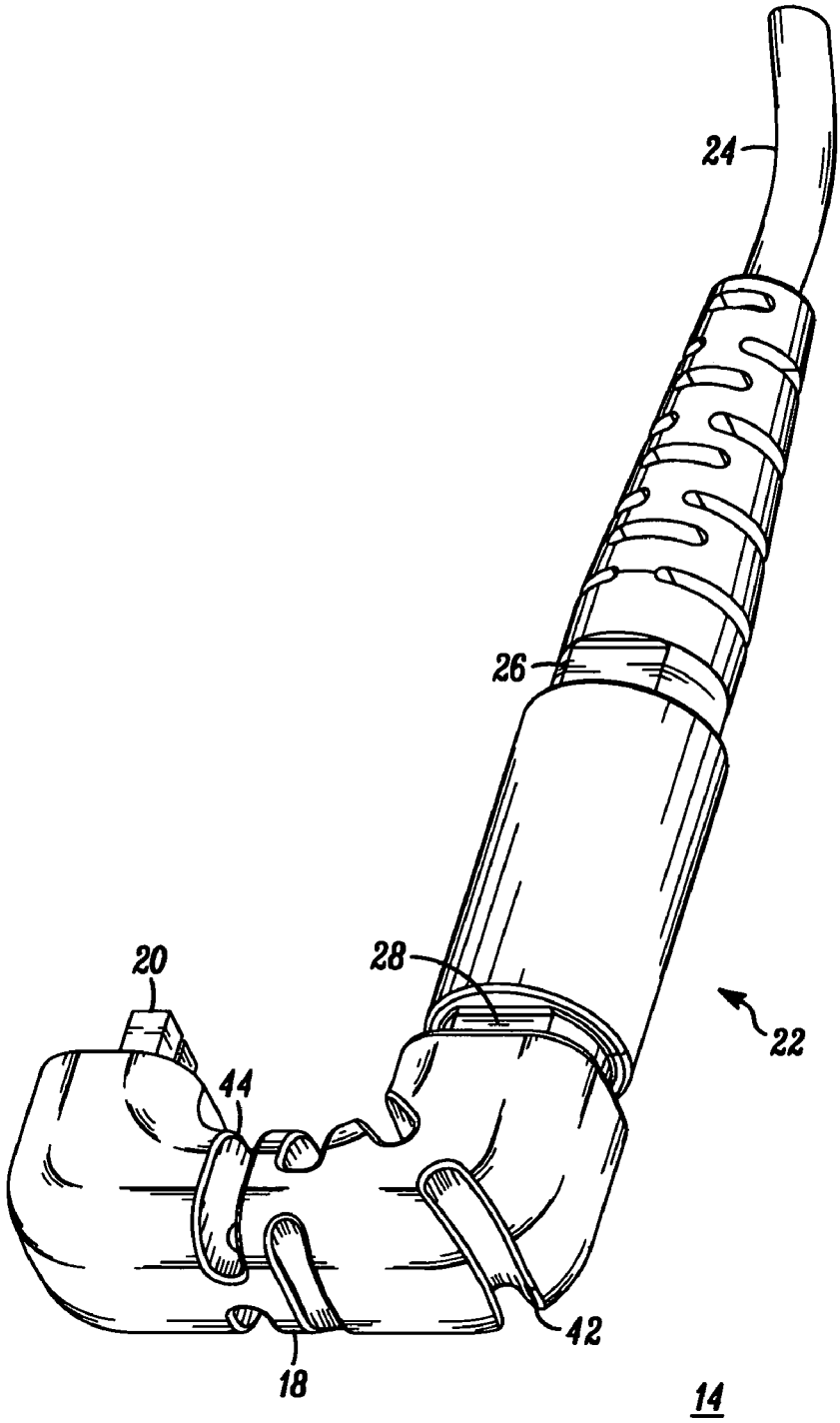
FIG. 2 shows a side perspective view of the connector assembly of FIG. 1.
Figure 3:
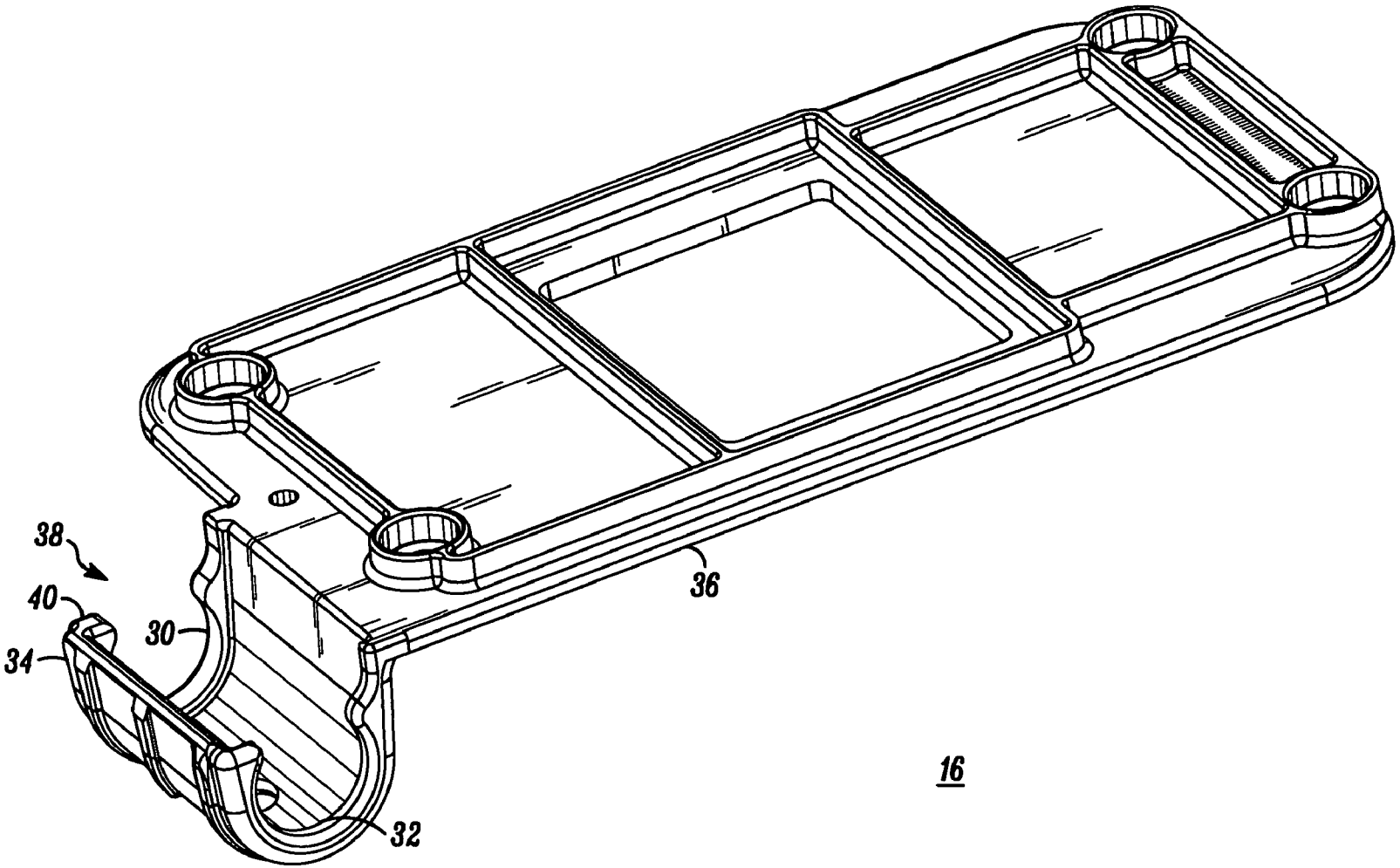
FIG. 3 shows a side perspective view of a cradle for the connector assembly of FIG. 1.

It should be noted that each groove 26, 28 of the stress relief overmold 22 has a flat area (shown on the upper surface in FIG. 2). The flat areas tend to lock the stress relief overmold 22 into the cradle 16 by moving the point of contact between the cradle 16 and stress relief overmold 22 away from the top of the stress relief overmold 22. Moving the point of contact away from the outside lip (edge) 40 towards the base of the semicircular recess increases the force that must be applied to the stress relief overmold 22 to dislodge the stress relief overmold 22 from the cradle 16.

The U-shape of the U-shaped connector head 18 functions to reverse the impact of on-axis tensile forces imparted by the cable 24. In this case, an on-axis tensile force is a pulling force on the connector assembly 10 that is coaxial with the longitudinal axis of the stress relief overmold 22 in its unstressed state. Instead of having forces that tend to pull the electrical connector 20 out of the connector socket 13 of the portable device 12, the U-shape causes the pulling forces to become compressive forces on the electrical connector 20 that actually push the electrical connector 20 into the connector socket.

The stress relief overmold 22 and cradle 16 functions to route off-axis pulling forces from by the cable 24 directly into the case of the portable device 12. Off-axis forces means that the force provided by the cable is not coaxial with the longitudinal axis of the stress relief overmold 22. In this case, the stress relief overmold is held in place relative to the portable device 12 by the cradle 16, thereby preventing any twisting forces from reaching the electrical connector 20. In effect, the stress relief overmold 22 and cradle 16 provide a means for dissipating off-axis forces directly into the case of the portable device 12.

In order to release the connector body 14 from the portable device 12, a user (not shown) may grasp the portable device with the user's forefingers and press the outside lip (edge) 40 outwards with the user's thumb. Pressing the outside lip (edge) 40 outwards releases the grooves 26, 28 from ridges 30, 32. With the user's other hand, the user may grasp the cable end of the connector body 14 and push the connector body 14 to the right (as shown in FIG. 1) until the electrical connector 20 disengages from the connector socket 13. The stress relief overmold 22 may then be twisted out of the cradle 16 to completely disengage the connector body 14 from the portable device 12. To reinstall the power cord to the portable device 12, the process may be reversed.

In order to allow a small amount of twisting of the U-shaped connector head 18, a number of slots 42 may be provided in the U-shaped connector head 18. The slots 42 allow the stress relief overmold 22 to be twisted out of the cradle 16 with the electrical connector 20 and connector socket 13 still partially engaged without damage to the electrical connector 20 or connector socket 13.

A specific embodiment of a connector assembly has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A connector assembly for a portable device comprising:

a U-shaped connector head with an electrical connector extending from a first end of the U-shaped connector head and a stress relief overmold extending from a second end of the U-shaped connector head, said stress relief overmold having a pair of annular grooves disposed along a length of the stress relief overmold transverse to the extension of the overmold; and a cradle mechanically coupled to the portable device that engages the pair of grooves to retain the connector head in a relatively fixed relationship with respect to the portable device when a force is applied to the stress relief overmold through a connector cable.

2. The connector assembly of claim 1 further comprising the electrical connector being adapted to engage a connector socket of the portable device in a direction that is parallel to the extension of the overmold.

3. The connector assembly of claim 1 further comprising a center portion of the U-shaped connector that is perpendicular to an axis of engagement of the connector and perpendicular to a predominant axis of the stress relief overmold.

4. The connector assembly of claim 1 further comprising a first groove of the pair of grooves disposed at a junction of the U-shaped connector head and overmold extension.

5. The connector assembly of claim 1 further comprising a second groove of the pair of grooves disposed at a base of the stress relief overmold.

6. The connector assembly of claim 1 wherein the cradle further comprises a pair of semicircular recesses that engage the pair of grooves.

7. The connector assembly of claim 1 wherein the cradle further comprises an attachment plate that attaches to a back of the portable device.

8. The connector assembly of claim 1 further comprising a plug for supplying power for the portable device.

9. The connector assembly of claim 1 further comprising a plug adapted to engage a cigarette lighter receptacle in a vehicle.

10. A connector assembly for a portable device comprising:

means for converting on-axis tensile forces on a cable of the connector assembly into compressive forces within an electrical connector socket of the portable device, wherein the means for converting further comprise a U-shaped connector head with an electrical connector extending from a first end of the U-shaped connector head;

means for directly dissipating off-axis tensile forces into a case of the portable device, wherein the means for directly dissipating further comprises a stress relief overmold extending from a second end of the U-shaped connector head and a cradle supporting the stress relief overmold coupled to the portable device wherein said stress relief overmold further comprises a pair of annular grooves disposed along a length of the stress relief overmold transverse to the extension of the overmold; and wherein the cradle further comprises a pair of ridges that engage the pair of grooves to retain the connector head in a relatively fixed relationship with respect to the portable device.

11. The connector assembly for a portable device as in claim 10 further comprising the electrical connector being adapted to engage the portable device in a direction that is parallel to the extension of the overmold.

12. The connector assembly of claim 10 further comprising a center portion of the U-shaped connector adapted to be perpendicular to an axis of engagement of the electrical connector and perpendicular to a predominant axis of the stress relief overmold.

13. The connector assembly of claim 10 further comprising a first groove of the pair of grooves disposed at a junction of the U-shaped connector head and overmold extension.

14. The connector assembly of claim 10 further comprising a second groove of the pair of grooves disposed at a base of the stress relief overmold.

15. The connector assembly of claim 10 wherein the cradle further comprises an attachment plate that attached to a back of the portable device.

16. The connector assembly of claim 10 further comprising a plug adapted to engage a cigarette lighter receptacle in a vehicle.

* * * * *